US012258194B2

(12) United States Patent
Ortega Collado

(10) Patent No.: US 12,258,194 B2
(45) Date of Patent: Mar. 25, 2025

(54) BAG-IN-BOX CONTAINER FOR STORING AND TRANSPORTING LIQUIDS WITH A MAXIMUM SECURITY TAP FOR CONSUMPTION DIRECTLY OR BY MEANS OF FLEXIBLE TUBES

(71) Applicants: Felipe Ortega Hernández, Madrid (ES); Natalia Ortega Hernández, Madrid (ES)

(72) Inventor: Santos Ortega Collado, Madrid (ES)

(73) Assignees: Felipe Ortega Hernandez, Madrid (ES); Natalia Ortega Hernandez, Madrid (ES)

( * ) Notice: Subject to any disclaimer, the term of this patent is extended or adjusted under 35 U.S.C. 154(b) by 250 days.

(21) Appl. No.: 18/014,477

(22) PCT Filed: Jul. 6, 2021

(86) PCT No.: PCT/ES2021/070490
§ 371 (c)(1),
(2) Date: Jan. 5, 2023

(87) PCT Pub. No.: WO2022/008775
PCT Pub. Date: Jan. 13, 2022

(65) Prior Publication Data

US 2023/0249887 A1 Aug. 10, 2023

(30) Foreign Application Priority Data

Jul. 7, 2020 (ES) ..... ES202030693

(51) Int. Cl.
*B65D 77/06* (2006.01)
*B65D 85/72* (2006.01)

(52) U.S. Cl.
CPC ..... *B65D 77/068* (2013.01); *B65D 77/067* (2013.01); *B65D 85/72* (2013.01); *B65D 2203/02* (2013.01); *B65D 2231/001* (2013.01)

(58) Field of Classification Search
None
See application file for complete search history.

(56) References Cited

U.S. PATENT DOCUMENTS

| | | | | |
|---|---|---|---|---|
| 9,586,804 | B2 * | 3/2017 | Ortega Collado ... | B67D 3/0074 |
| 2012/0211519 | A1 | 8/2012 | Hauner | |
| 2023/0249887 | A1 * | 8/2023 | Ortega Collado ... | B65D 77/067 222/105 |

FOREIGN PATENT DOCUMENTS

| | | |
|---|---|---|
| EP | 3374314 | 9/2018 |
| FR | 2590642 | 5/1987 |

(Continued)

*Primary Examiner* — Paul R Durand
*Assistant Examiner* — Michael J. Melaragno
(74) *Attorney, Agent, or Firm* — PHILLIPS LYTLE LLP

(57) ABSTRACT

The invention relates to a bag-in-box container for storing and transporting liquids with a maximum safety tap for direct consumption through flexible tubes, for housing a filled bag with two opposite vertical positions for handling and transport, and another position for dispensation, with better safety control and a content outflow anti-blocking system; and spouts with direct connection to tube lines for the conduction of and mixing with other products at a distance, or for visible dispensation without touching the container at a shorter distance, with another end tap, a flow interrupter with a deformable elastic element connected with flanges that can be actuated between normal and safety closed positions, a nozzle that can be connected to one of the spouts for direct dispensation into the mouth, and a set of measurements printed on the box to help sorting and recycling the components of the container.

20 Claims, 4 Drawing Sheets

(56) References Cited

FOREIGN PATENT DOCUMENTS

| | | | | |
|---|---|---|---|---|
| FR | 3619612 | | 2/1989 | |
| WO | 0198158 | | 12/2001 | |
| WO | WO-2009125032 | A1 * | 10/2009 | ..... B65D 77/067 |
| WO | 2014125131 | | 8/2014 | |
| WO | 2018104973 | | 6/2018 | |

* cited by examiner

BAG-IN-BOX CONTAINER FOR STORING AND TRANSPORTING LIQUIDS WITH A MAXIMUM SECURITY TAP FOR CONSUMPTION DIRECTLY OR BY MEANS OF FLEXIBLE TUBES

CROSS REFERENCE TO RELATED APPLICATION

This application is a U.S. National Phase of International Application No. PCT/ES2021/070490 filed Jul. 6, 2021, which claims priority to Spanish Patent Application No. P202030693, filed Jul. 7, 2020, both of which are incorporated by reference herein in their entirety.

TECHNICAL FIELD

The present invention can be included within the sector of container, package, and in particular of the transport, packaging, and handling of liquid products (in general), which, as a result of being sensitive to certain gases and/or environments (for example, of being subjected to oxidation if left exposed to the atmosphere) require the advantages that they provide when being packaged and transported in bag-in-box containers equipped with a tap so as to enter a new era. More specifically, the object of the invention relates to a dispensing tap with improved safety for the content of said flexible containers for liquid products, which require continuous protection in various environments, so that the content lasts without its quality and various characteristics being compromised, for dispensing and delivery of the total content of each container, with other auxiliary means for delivery or mixtures at a distance, only of the content. The container is also prepared to use two options: one for handling and transport and another for dispensing, rotating it to its opposite base 180°, in a controlled and visible manner. Furthermore, it presents, as a characteristic of the tap, an easy and safe connection through another eccentric spout attached to the body of the tap, also equipped with external circular grooves, for the purpose of preventing the blocking of the outflow of the already limited content in the container. Another tube of the same diameter as the preceding one, both being able to be connected to plastic tube lines, both at the end of the line and at intermediate points, as auxiliary elements for accessory changes and repairs, reducing problems and content losses, along the entire length thereof. The printing of identification instructions for all the components of the container necessary for their sorting, recovery, and recycling is also envisaged.

BACKGROUND OF THE INVENTION

Document WO2014/125131A1 (Santos Ortega Collado) also relates to a safety tap for containers containing liquids sensitive to certain gases and environments, where the containers are preferably bag-in-box type containers, which are also referred to as "pouch", for containing liquid products of different levels of viscosity, such as wine, for example, which oxidize in contact with the atmosphere, degrading and therefore losing quality and organoleptic characteristics. The bag-in-box container comprises a plastic bag to contain the liquid and a stabilizing cardboard box or the like to house the bag. The so-called "pouch" consists of a plastic bag or the like with a tap in its upper part, with the characteristic of staying upright. In turn, the tap comprises a hollow base body which can be coupled to the bag at a first end of the base body, with a female connector welded to the bag and including a closing seat equipped with an access spout, so that the liquid accesses the base body from the bag through a tube arranged in an eccentric position, with two intersecting cuts at the final edge thereof, eliminating the blocking of the outflow of the content. A pour spout allows the liquid to flow out of the base body. The base body also includes windows on its periphery, constituting movement guides for tabs which can be operated in opening and closing maneuvers with simple operation, as will be explained below.

The tap further includes a bushing movable along the inside of the base body, attached to the aforementioned flanges, which project from a second end of the base body and slide in a guided manner through the corresponding windows of the base body. The flanges can be operated, within the windows, with a special design to move the bushing within the base body, moving the bushing away from the closing hole, from a normal or safety closed position, in which the liquid does not access the pour spout, to an open position in which the pour spout is accessible by the liquid, with the characteristic that, by subsequently leaving the flanges free, the tap closes automatically in the normal closed position of which a portion of the content in the body has already been emptied through the pour spout, and once it is closed, the rest of the content in the main body goes back into the container, with the two spouts being closed in their two different positions and the main body being empty.

It also includes a deformable elastic element internally linked to the base body, as well as a shutter located at a second end of the bushing, opposite the first end, the shutter being fastened with the elastic element with a semi-circumferential polar shape. In this way, in the closed position, the elastic element is interlocked, pressed, and deformed in its polar part, due to the deformation of the shutter, with an increase in its radial pressure in the polar part, against the closing seat, to block the access hole, on the outside of the main body thereof, preventing the liquid from accessing the base body, through the second spout and to the outside through the third spout.

In said normal closed position, the elastic element exerts a recovery thrust force on the bushing. As a result, the elastic element deforms, increasing the circular pressure in its polar part by means of the residual pressure, linked to the shutter. Deformation with increased polar pressure, by means of reduction of the semi-circumferential polar shape thereof, which also increases the difficulty of opening by thrust in normal closure, and even more so in forced and supported safety closure, by prior rotation of the fins, applying the complementary support of the safety closure assembly, which eliminates any possibility of movement, as long as the pressure of the flanges is not released.

The base body additionally includes grooves, in prolongation of the windows, to allow the flanges to be rotated axially, such that the flanges are housed in the grooves up to their end with leverage towards the closure, with the safety "click" and thus blocking the axial movement of the bushing, maintaining the safety closed position, to prevent the degradation of the contained liquid, due to possible inflow of air or outflow of content due to accidental impacts, which, although rarely, can damage the content and container, destroying the unit for the loading of multiple units as a result of wetting, in all its aspects of risks and damages.

It also includes a seal that prevents accidental opening of the container, by means of retaining the flanges in the safety closed position, housed at the bottom of the grooves, with increased closing pressure and fixing of said safety position, until the separation of the seal, with easy elimination of the safety position, for the opening thereof.

The new safety tap has: different and extended features, although in practice it has the same four parts equivalent in number, but modified one by one, achieving new and important achievements, among which it is worth highlighting a structure that prevents dripping of the product contained within the tap once closed, as well as the generation of a much more uniform outflow stream, that is, a circular flow that prevents splashes and makes the use of said tap more comfortable.

DESCRIPTION OF THE INVENTION

The present invention seeks to solve the detailed problems, in the state of the art, among others.

The present invention describes a greatly improved multiple safety dispensing tap, for flexible containers of liquid products, which provides, with respect to the taps of the state of the art, also improved performance in terms of: preventing liquid product oxidation, content loss, and guaranteeing the inviolability of the container once opened with prior removal of the seal, with the final safety being the use of a padlock that provides maximum reversible safety.

The tap of the invention is adapted to provide the performance indicated above, for any type of liquid product, including those that are sensitive to deterioration in certain atmospheres. A preferred application of the tap is to protect liquid foodstuffs packaged and transported in bag-in-box type containers from oxidation, once they have been made available for consumption, such as mainly wine, but also oil and preparations for refreshments, liquors, etc. To obtain mixed beverages in a more or less automatic manner, it facilitates the use of connectors, transfer pumps, dispensers of many different types, as well as a permanent opening of the tap to be used together with one or more intermediate safety taps, which can be handled even up to the end of the line, furthermore preventing the possible blockage in the outflow of the content from the bag when it is avoided, in a suitable manner, the internal attachment of one of the faces of plastic material facing the tap making up the bag, at a point of partial emptying of the bag, with the subsequent loss of product, which tends to occur when the content of the container is reduced and the two mentioned parts are moved closer to one another.

More particularly, the present invention discloses a safety dispensing tap, for liquid product containers, wherein the container comprises: a flexible bag to contain the liquid product; and a stabilizing box, in which the bag is housed once it is filled with the liquid product; the tap comprising:

- a hollow main body, comprising a first end and a second end, which are open;
- a connector, at one end of the main body, to be coupled to the bag through another connector welded to the bag;
- a second spout, at the first end of the main body in an eccentric position with cuts, to be in fluid communication with the bag and allow the liquid product to access the main body from the bag, without the possibility of blockage.
- a spout, in the main body, and communicated with the second spout through the main body, to serve the liquid product through the main body;
- two windows, at the second end of the main body, going through the main body;
- an access hole, within the main body, in fluid communication with the third spout and through the second spout;
- a flow interrupter, housed in the main body, and further comprising a first deformable portion that can be internally adapted to the main body, and another second elastic-deformable portion, depending on the first portion, to alternately cover the access hole and leave it free;
- an actuator assembly, housed at the second end of the main body, comprising: a bushing movable in the axially rotating main body and a shutter fastened with the movable actuator element;
- respective flanges, projecting from the bushing through the windows, which can be operated to move the bushing away from the closing seat, from a closed position, in which the liquid product does not have access to either of the two spouts, to an open position, in which the liquid has access to the main body and, accordingly, to the two spouts;
- And first grooves, in the main body, in prolongation of the windows, for housing the supports of the flanges in the safety closed position by means of the axial rotation of the flanges and of the bushing simultaneously, with a safety "click";
- wherein the second spout configured as a hollow connector, projecting from the access hole, towards the bag, away from the main body, to reduce the access diameter with respect to the bag through the internal connector, reducing the pressure reaching the main body, as a result of possible external impacts, avoiding the conicity of the part of attachment with the hollow dip tube, said dip tube forming one and the same part piece with respect to the dispensing tap, for safe connection of flexible tubes from other safety taps for complementary closing and opening and at the end of each line.

Furthermore, the first grooves are designed to cause a movement towards the access hole. This provides greater pressure, because said complementary thrust in the safety closed position, by fixing at the ends of the grooves, by means of a safety "click" maintaining said position, which together with the guarantee seal, will be applied together, maintaining the safety of the container and content, until the seal is removed and it is free for opening, operating only on the flanges. Before it is assembled in the bag, the tap is assembled in said safety position and with the safety seal, also from its manufacture.

Preferably, the main body further comprises second grooves, also in other opposite prolongations of the windows operating with rotation in the opposite direction, in contact with the closure of the cover, for housing the same flanges and maintaining another fixed permanent open position, also by means of axial rotation of the bushing in the opposite direction and therefore, of the flanges, blocking the axial movement of the bushing, with a fixing and safety "click", maintaining the permanent open position at will.

It should be noted that the arrangement of the second grooves is particularly advantageous when the tap is to be kept in an open position for a long time, for example, when the liquid content is served, through direct connection of flexible tubes, to the third spout to a place distant from the bag-in-box container, in the position of which it can be directly connected to the eccentric tube by means of flexible plastic tube, another unit of the same safety tap, for dispensing the content at a distance with all the advantages that are described in detail, facilitating any more or less complex operation in the line, by simply operating on the inserted taps, without a connector as an aid to facilitate different operations, reducing content losses and helping in operational needs and the emptying of bag-in-box units, without having to move the container.

Likewise, radial fins are preferably internally configured in the third spout, along the second third of the spout to retain and prevent dripping of the liquid product, when the tap is in the closed position after each dispensing, said spout having therein a reduction in diameter at its final edge, to retain the liquid in reduced quantity, hanging between the end of the fins and the raised circle at the inner end of the spout.

The safety tap further incorporates a cover that covers the second end of the main body, to prevent access and retain the actuator element in contact with said second end, supported at the end of another second safety groove, securing the elastic element at its final edge, wherein the cover has on its outer part, a bulged and polished central part, to reduce the resistance to rotation from contact with a user's finger, when it rests on said cover to rotate the flanges, for permanent opening.

Preferably, the main body includes two penetration holes, at the second end of the main body, which are through holes going through the body and the cover in the cylindrical portion thereof, wherein the penetration holes are in contact with the bushing located at the level of the safety closed position, to maintain said position at the user's will, by means of the assembly of a padlock, obtaining safety that is superior to that available before the first opening, even before the removal, of the safety seal.

DESCRIPTION OF THE DRAWINGS

As a complement to the description that will be provided herein, and for the purpose of helping to make the features of the invention more readily understandable, according to a preferred practical exemplary embodiment thereof, said description is accompanied by a set of drawings constituting an integral part thereof in which, by way of illustration and not limitation, the following is represented.

PREFERRED EMBODIMENT OF THE INVENTION

Figure 1:
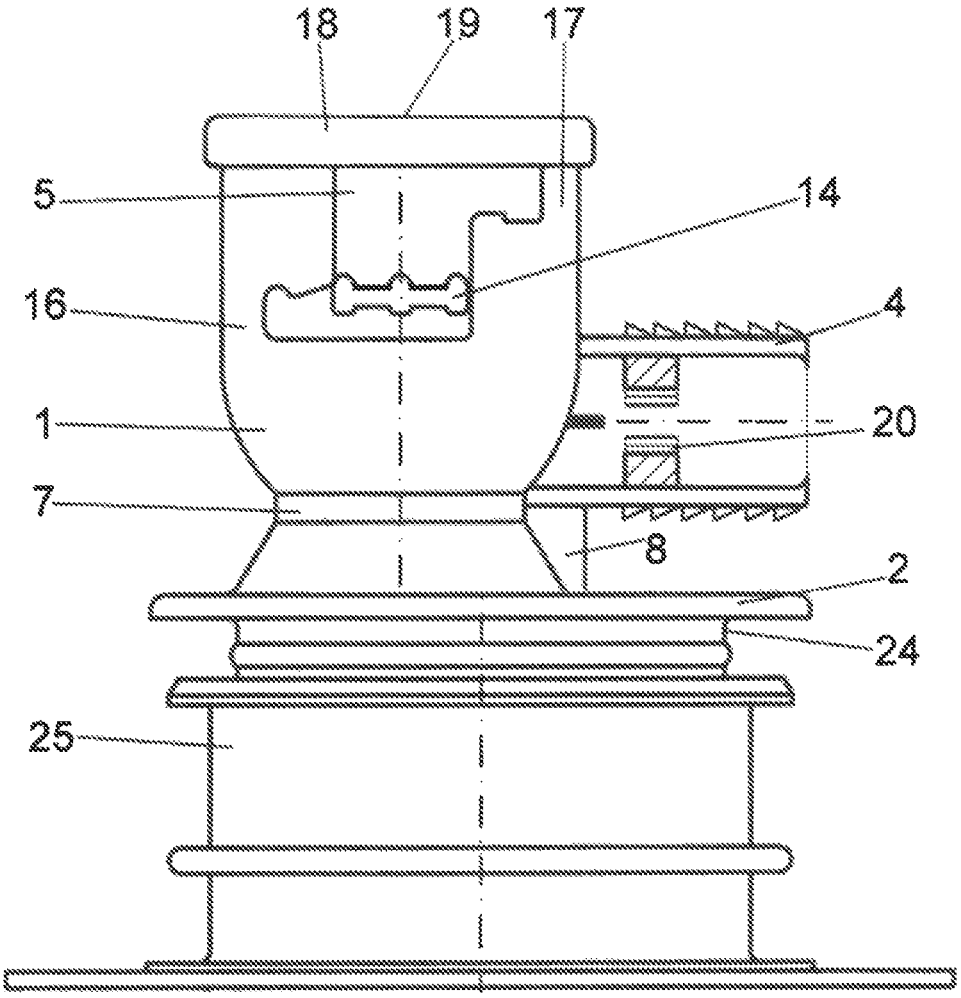
FIG. 1 shows a profile of the safety tap, rotated 90° with respect to FIGS. 2 and 3 with the design of grooves (16) for safety closure and other grooves (17) for permanent opening through the third spout (4) and incomplete connection of both connectors (24) and (25) which corresponds to the transport position for transporting empty bags in an easy-to-remove position for the filling operation and complete safety connection urged by the seal, from the base of the tap of the container with the taps assembled in the empty bag, which are easy to open for filling.
Figure 2:
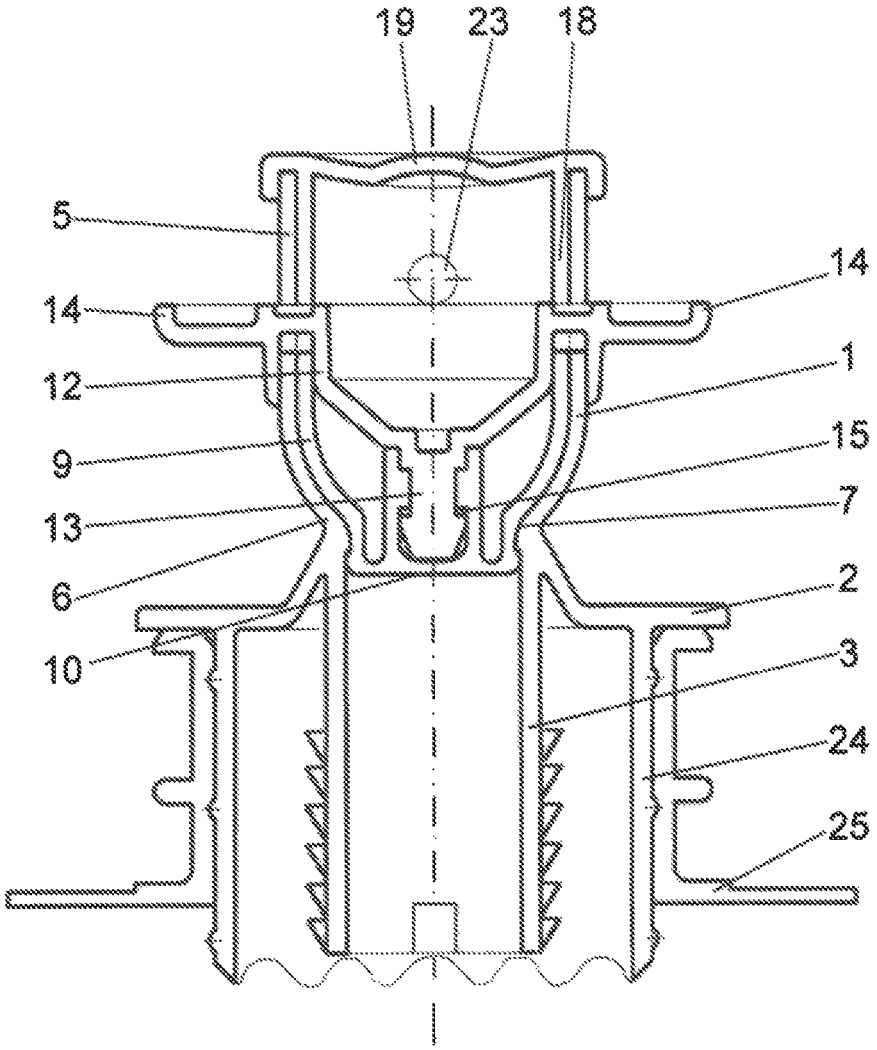
FIG. 2 shows a profile of the tap of the container of the invention in the closed safety position without a seal.
Figure 3:
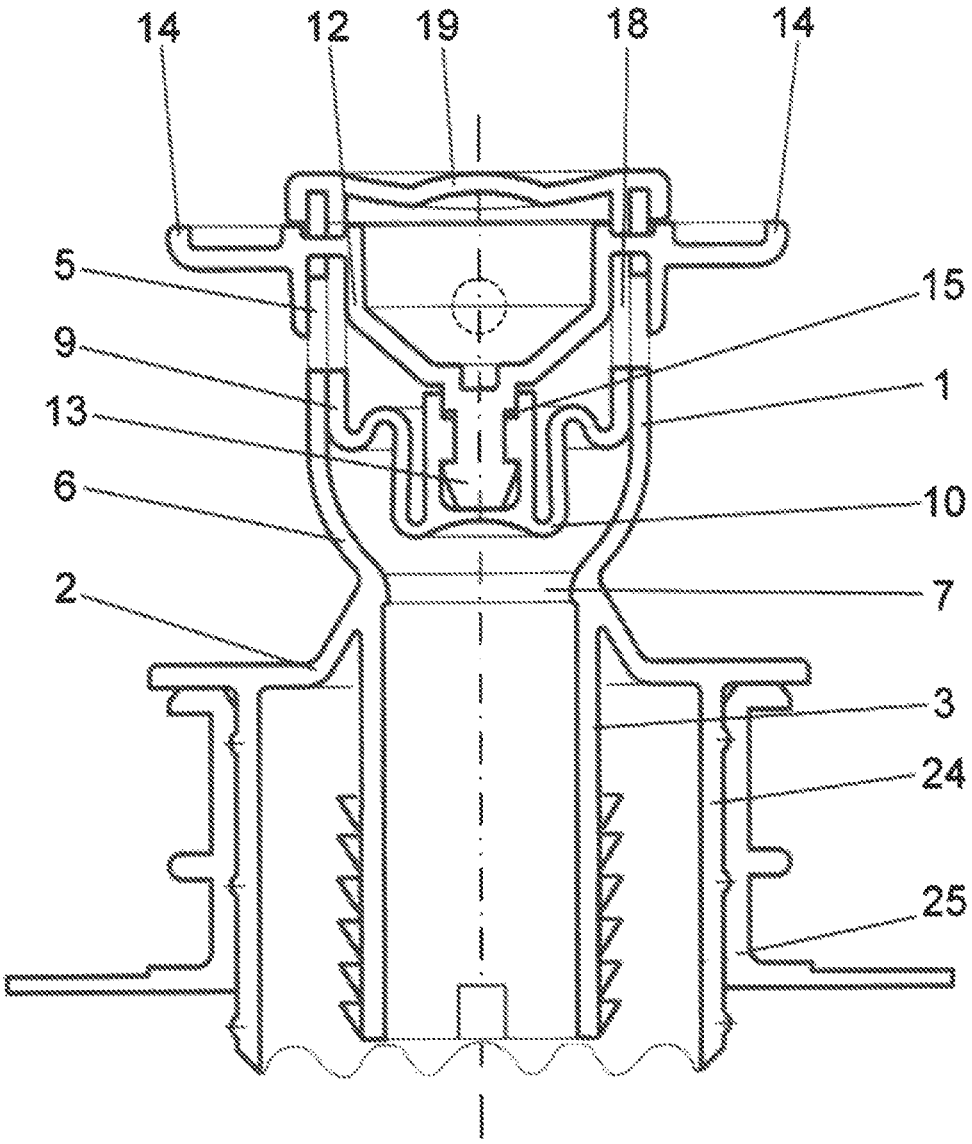
FIG. 3 shows the same profile of the tap of FIG. 2, but in the open position for dispensing.
Figure 4:
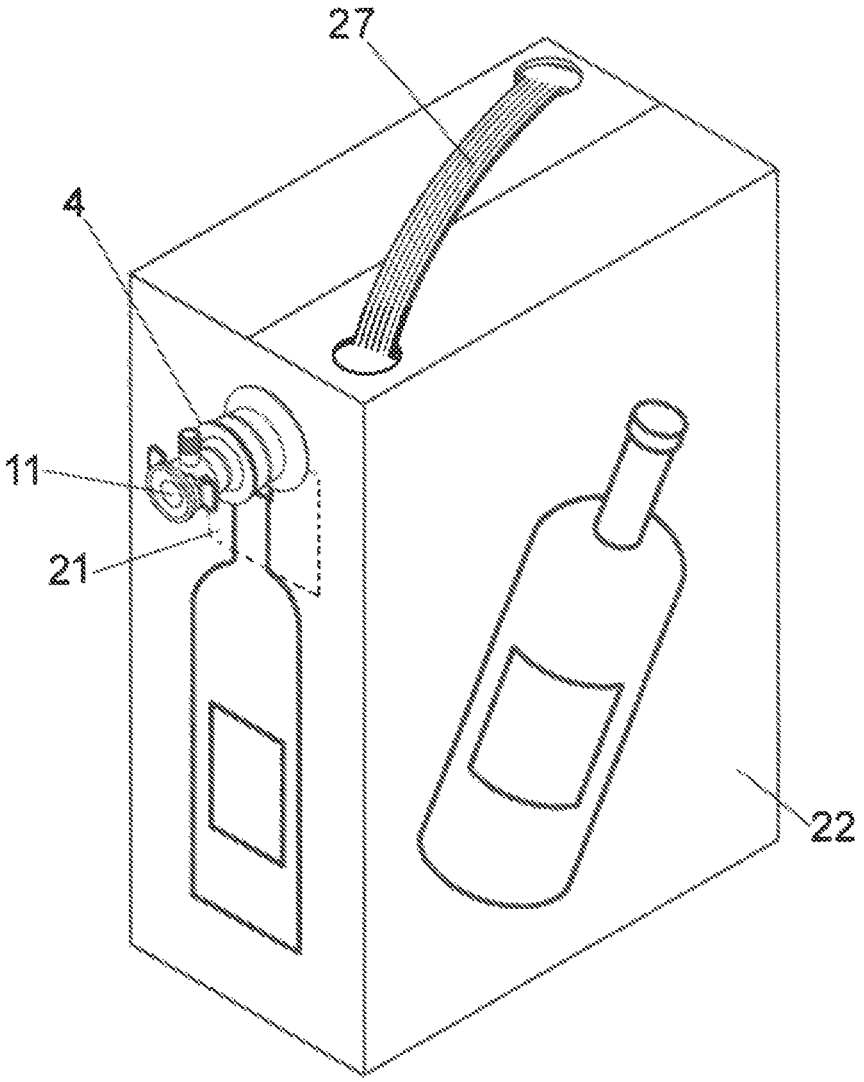
FIG. 4 shows a bag-in-box container in the transport position, with the tap already assembled on the outside of the box in the dispensing position, pending only the vertical 180-degree rotation of the container in order to transition to the normal dispensing position by means of the prior removal of the seal.

Regardless of the advantages provided by the necessary use of two positions: first, for transport and handling, and second, for dispensing the content, with easy detection of generally costly and even dangerous leaks, with different prints on the 4 sides of the box inverted two by two, so that they are legible in both positions and detailed and printed instructions clearly visible on the face of the handle for the recovery, sorting, and recycling of all the components of the container, which together with the different position of the tap, also printed on the upper portion of the box on a narrow side of the box, with the dispensing spout oriented upwards, presents a considerably different image, constituting a possible commercial advantage.

A detailed description of a preferred exemplary embodiment of the present invention is provided below with the help of the attached figures mentioned above.

The present invention relates to a safety dispensing tap for flexible bag-in-box type containers comprising: a bag with its tap to contain a liquid product, preferably a liquid food, such as wine; and a stabilizing box, such as a stabilizing cardboard board or the like, in which the bag is housed once it is full.

The objective of the tap of the invention is to maintain safety and inviolability to prevent access to the content of the bag-in-box container by unauthorized persons in various circumstances, such as: before the first opening of the tap; as well as after having opened the tap for the first time and the seal removed, according to various degrees of safety closure, as will be explained below.

The tap of the invention comprises a hollow main body (1) provided with a first end and a second end, which are open. The main body (1) comprises at the first end a coupling (2), of the connector (24), to be coupled to another connector (25) welded to the bag of the container. In addition, there is defined at the first end of the main body (1) a second spout (3) which, in the position of the connected and filled container, is intended to be in fluid communication with the bag, of the same type and diameter as the third spout (4), to ensure that the liquid product can access the main body (1) of the tap from the bag, located in an eccentric position and with vertical intersecting cuts at the end thereof as means to prevent the tap from being blocked due to plugging, as a result of the suction force, from the outside through the third outlet spout (4), which can give rise to the approximation and blocking of the sheet of the bag facing the two connectors (24) and (25) and even more, when they are connected with said third spout (4), flexible or rigid plastic tubes, where appropriate, for conducting the contained liquid at a distance, to insert in the installation of external accessories known in the art such as connectors, pumps, flow regulators, safety taps, etc., for metered mixtures with other components, obtaining other final products, more or less automatically.

In addition to directly serving the liquid product in a cup, glass, bottle, etc., the third spout (4) can also be configured to be coupled by means of a tube with a variety of installations, directly to the second spout (3) of another safety tap connected from a more or less short tube, in order to dispense the content in areas close to the container, from containers located at a reasonable height, in manner that can be controlled without the need to move them, which implies comfort and safety, furthermore providing increased confidence, on the part of the users. A support (8) is also included from the third spout (4) to the coupling (2) that is applied together with others as a reinforcement of the third spout (4) in its connections.

Two windows (5) going through the main body (1), located in opposite arrangements, are arranged at the second end of the main body (1).

There is arranged inside the main body (1) an access hole (7), preferably defined by a closing seat (6), which is in fluid communication with the second spout (3) and with the third spout (4), and which after each closure the main body is empty of liquid product, whereby the isolation of the product in the bag increases, during the intervals that occur between consecutive services, due to the duplication of closure of both spouts (3 and 4) and the emptying of the intermediate area of the main body (1) between both spouts.

The tap additionally comprises a flow interrupter, housed inside the main body (1), in correspondence with the closing seat (6) and the access hole (7). The flow interrupter comprises a first elastic portion (9) secured and pressed at the end of the final tube of the cover, internally fixed to the main body (1), and continued with a deformable elastic element (10), with increased pressure in prolongation of the first portion (9) to alternately cover the access hole (7) and leave it free with partial exit of its hemispherical-shaped polar finish (10) which in the normal closed position reduces the hemispherical curve that ends up being even flat, with pressure and final safety fixing, achieved by rotating the flanges (14) through the safety grooves (16), with fixing by means of safety "click" retention.

The tap additionally comprises a shutter element (13) housed at the first end of the main body (1). The shutter element (13) comprises an axially rotating bushing (12) that is movable along the inside of the main body (1). The bushing (12) further comprises a shutter (13) fastened with the elastic element (10), the elastic element (10) from its origin, with a hemispherical shape in its polar part, being susceptible to radial deformation, of its polar part, by forced thrust due to the rotation of the flanges, within the safety grooves (16) upon causing the movement of the elastic element (10) through the access hole (7). Respective flanges (14) project from the bushing (12) to achieve safety closure by means of rotation through the grooves (16), achieving complementary pressure with permanent support from the original assembly of the tap, until the removal of the safety seal, for opening and dispensing that can be recovered when desired, even without a seal, by means of using the padlock that provides greater safety and can be reused as many times as necessary.

In the safety closed position, the deformable elastic element (10), pushed by the shutter (13), pressing against the closing seat (6), to close the access hole (7), advantageously, as a result of its deformation with an increase in its radius once outside the main body (1) and the access hole (7). Likewise, the elastic element (10) is configured to exert its own recovery force on the shutter (13) to cause, first, the normal closed position and, where appropriate, the safety closed position by the movement of the flanges (14), through the grooves (16) in an axial position, with safety "click".

To open the tap, the connection between the shutter (13) and the elastic element (10) by means of opening traction, the recovery of the polar hemispherical shape occurs, reducing the diameter thereof and facilitating the entry thereof into the main body (1) and also the passage of the content, through the access hole (7) to the outside through the third spout (4).

Preferably, the main body (1) further comprises second grooves (17), also in prolongation of the windows (5), for housing the flanges (14) in a permanent open position, also by means of the axial rotation of the bushing (12) and, therefore, of the flanges (14), in the direction opposite the safety closing direction, in the part for attaching the body (1), with the cover (18), which is visible to block the axial movement of the bushing (12), at the end of the grooves (17) with a fixing "click", maintaining the permanent opening position at will. The arrangement of the second grooves (17) is useful when the tap is to be kept in the open position for a more or less prolonged time, for example, when the liquid content is served, by means of the direct connection of a black flexible tube to the third spout (4), using another final connection to either the second spout (3) or third spout (4) of another safety tap for direct dispensing at a smaller distance, so as to avoid constant and uncomfortable handling of the bag-in-box container.

The tap additionally comprises a cover (18) with the seal attached, which covers the second end of the main body (1), to prevent access, retaining the safety seal until it is voluntarily broken, separated and removed, at the time of first opening and also of the kept safety position, which can be recovered, as many times as deemed appropriate, according to the user's criterion.

The support (8) constitutes the support point for the third spout (4) reinforcing together with three other internal reinforcements the connections and disconnections of said third spout (4). A bulged central portion (19) to reduce the contact surface with a user's finger (generally the thumb) when it rests on the cover (18) and (19) to facilitate the rotation of the flanges (14). The reduction of the contact surface facilitates axial rotation, on the safety and permanent opening grooves (16 and 17), both with the fixing "click".

It should be noted that, in current taps, the closing force achieved is equivalent to that which must be applied directly when opening the tap: which implies that safety in the closed position depends on the opening force that must be applied by the user, which is limited by the user's own comfort. On the contrary, in the tap of the invention, the generalized force applied for opening, when automatically applied for normal closing, is equivalent, but the closing pressure in the polar part of the elastic element (10), allows the residual closure force, to slightly reduce the polar hemispherical configuration of the elastic element (10), with the subsequent increase in polar diameter that reduces the possibility of accidental opening, and accordingly also the passage of air into the container, preventing the need to quickly consume the content, once opened, which can still be definitely improved, with the application of the easy and comfortable safety closure, with the rotation of the fins on the grooves (16) obtaining complementary force to maintain the polar flatness of the elastic element (10) and the fixing of said maximum safety closed position by means of the protection and thrust, of all the closing elements: (12, 13, 14, 9,10 and 16).

In the third spout (4), radial fins (20) are internally configured in the inside thereof, separated from the body by one third of the length of the third spout (4) and running along the third spout (4). To retain the liquid product and prevent it from dripping when the tap is in the closed position after each dispensing and the fins (20) are interrupted before reaching the free end of the third spout (4) separated by another third, creating a space between the fins (20) and the free end of the third spout (4). In this way, every time once the tap has been opened, the remaining liquid product wetting the third spout (4) internally accumulate in contact with the fins (20) in the aforementioned final space, being retained at the edge of the third spout (4), with a reduction in its final or end diameter and, therefore, being converted into a circular inner edge determining retentions means for retaining said relatively cumulative wetting, thereby significantly reducing dripping. The fins (20) furthermore provide the additional effect of stabilizing the liquid product which comes out more uniformly in stream to the outside of the third spout (4), with the added advantage of regularizing the normal outflow stream of the content of the container.

The safety tap can be useful, on many occasions, for safety padlock applications, inserting by penetration through the holes (23), fixing the safety closed position of the assembly (9), (10), (12), (13) and (14), by means of prior insertion and fixing to the safety grooves (16).

The usual closure of bag-in-box taps is usually based on a so-called "simple" closure, with a relatively soft pushed cap, by the recovery of the deformation of an elastic, direct penetration part, which on one hand makes it necessary for the user to generally have to apply a greater effort in the opening for a closure, which may be insufficient, once opened for the first time, given the removal of the safety seal when it is available, leaving the liquid product at risk of air penetration, which can increase accidentally, due to impacts on the container during handling and transport, therefore, as indicated in many bag-in-box type containers, the liquid product (wine, mainly) only guarantees 4 or 6 weeks (maximum 8) in adequate conditions since its first opening, so it is clear that a simple closure cannot be considered sufficient.

According to another feature of the invention, it has been envisaged that a space (15) is defined between the shutter (13) and the elastic element (10), as recovery means at the start of the opening movement, once released from the pressure of the shutter (13) from the flanges (14) through the grooves (16), said elastic element (10) adopting its own hemispherical polar configuration, once free in said opening movement, offering easy exit of the elastic element (10) through the access hole (7), from a maximum safety closed position, reduced to normal safety closure.

Regarding the positioning of the container, it is worth noting the following:

Two positions of the bag-in-box container: The first position for handling and with the tap upwards and the spout of the tap also in the upward position and direction and the second inverted position with support in the opposite vertical position of the container, with the handle (27) and the tap downwards fixed on the outside ready for dispensing. With the first position if content leaks occur, which are not frequent, although not always detectable in the filling process, in the bag position: full and horizontal, such that if leaks not are detected in said cycle and before loading same for transport, the problem may arise from that moment and will not become apparent in this case, until the container transitions to the second position, which leads to the conclusion that the problem can eventually be remedied by turning the leaking containers over, transitioning to the first position, if they are detected outside the filling process, with the option of recovering the content and its cost if returned.

In any case, the container will be supplied with the bag inside the box, in a vertical transport position, perfectly closed and secured with glue on the flaps, with a plastic outer handle (27) and the tap (11) on the inside, close to an outlet perforation (21) for easier extraction and fixation thereof in its position with the third spout (4) oriented upwards, suitable for transitioning to the dispensing position, by rotating the container 180° vertically, in which the handle remains under the pressure of the container, suitable for breaking and removing the safety seal from the maximum safety position of the tap (11), for opening and dispensing.

The container, in addition to the use described, offers other possibilities, such that the new second spout (3) and the third spout (4) determine flexible tube connection means, in independent normal dispensing operations at a short distance, visible for direct dispensing, without having to move the bag-in-box container, which is possible by means of the connection of a second safety tap without a connector (25) at the end of a flexible tube, connecting it to its second spout (3), both privately and commercially, with one or more units from different brands, for example wine, visible in the line.

Another possibility consists of the fact that consumption is carried out through flexible tubes, such that the tap allows the exit to the outside through the third spout (4) prepared for the adjustment and retention of preferably black flexible plastic tubes, inserting the standard accessories required for the connection and transport of contents at a distance, for metered mixtures of various liquid and gas products, where it is possible for there to be more safety taps without a connector (25), inserted in the path or at the end, which can be connected to the most suitable one of any of their respective second spout (3) or third spout (4), when required for changes of complementary elements of the lines, preventing content loss.

Additionally, it has been envisaged that the container offers the possibility of dispensing by means of a direct stream into the mouth, with an elastic nozzle, coupled to the third spout (4) of the tap, with a very small outlet hole, without the need for glasses or cups, equivalent to the use in Spain of "wineskin" and "wine jar" preferably in said refillable containers, the first being made of leather and the second glass.

The possibilities of improved safety to obtain a more leak-tight and secure closure than that provided by the present invention are set forth below.

a) The deformability of the elastic element (10), to adapt more closely to the access hole (7), modifying its shape in its polar part, by reducing or eliminating its polar hemispherical shape by means of pressure, with the subsequent effect of increasing the radial pressure thereof. In this way, it enters into both a normal closed position and a safety position, preventing the elastic element (10) from moving from the access hole (7), while there is retention in the grooves (16) and subsequently an increase in pressure, fixed by the shutter (13).

b) The main body (1) of the tap, as well as the flanges (14), are configured to produce a clipping engagement (a "click" sounds) at the end of the path equivalent to half the width of the supports of the flanges (14), within and at the end of the grooves (16) in the second portion of the main body (1).

c) Likewise, there is provided a seal that keeps the tap closed in a maximum safety position before the first opening following the manufacture of the tap. Once the seal has been removed, the tap is accessible for the extraction of the supports of the flanges, from the grooves (16) transitioning from maximum safety closure to improved normal closure, with instantaneous opening.

d) After each dispensing of liquid product, from the normal open and closed position, releasing the flanges (14), the safety closed position can be adopted again, housing the flanges (14) again, depending only on the time until the next opening and on the interest of whoever performs the operation, to ensure the remaining content of the container in perfect conditions.

e) Additionally, the padlock can be used, which, in addition to preventing the actuation of the flanges (14) to extract the liquid product, from the maximum safety position, places the container and its content in a new position that greatly improves the position that it had before the first opening thereof.

f) Unlike other taps, a person who wants to extract liquid product from the third spout (4) will not be able to circumvent the tap of the invention, if he/she does not destroy the tap, the bag or the padlock, because from the safety closed position, and even more so with the padlock in place, the elastic piece (10) cannot be moved, because it also secures the position of the assembly (9), (10), (12) and (15), as long as the position of the padlock is maintained.

g) Although not depicted in the figures, when the container is intended for consumption to be carried out through flexible tubes, the taps allow entry and exit to the outside through either of the second spout (3) and the third spout (4), with the same external diameter, prepared for the adjustment and retention of preferably black flexible plastic tubes, inserting the standard accessories required for the connection and transport of contents at a distance, for metered mixtures.

h) Based on this structure, the container allows containing, isolating, transporting, dispensing, sorting, and recycling its components, reducing waste both from the cardboard of the box (22), and from the plastic components: bag with tap (11) and plastic handle (27) fixed on the box.

i) It only remains to point out that the container can incorporate striking direct print on the face of the handle, or a label, with complementary instructions for the reformulation of bag-in-box containers, in order to reduce the global onslaught of plastic as extremely harmful, almost irrecoverable waste, basically aimed at improving sorting and recycling.

Finally, it is worth noting the importance and advantage of the container of the present invention from the recycling viewpoint.

In this sense, the container will allow its components to be sorted and recycled: the cardboard box (22), the bag with or without a tap (11), fixed inside the box and a plastic handle that can also be separated from the box by means of pulling and being torn from the pre-perforation (21) that was already used for extracting and positioning the tap, for opening and dispensing the content, also usable for tearing and reducing the volume of the box and sorting all the components of the container, improving its recovery and recycling.

This structure has been designed to reduce the global onslaught of plastic waste, which is always difficult and even impossible to recycle, even though there are already additional acceptable options for recycling different compounds in the "compost" chapter, improving sorting, because it is difficult to sort what is not known, particularly taking into account that the different plastic sorters in recycling depots are not usually technical, and even if they were, it would not be safe, because in terms of plastics which should be officially controlled, what is being manufactured should be controlled and recycled to the extent possible.

Therefore, at present, containers of this type have been posing difficulties for recycling, based on the use of a high technical level, in both the bag made with multi-layer materials, and the tap as a result of the difficulties it presents due to the mixing of more combined materials that are not always compatible when melted, but that still have to be sorted and recovered, for which purpose, the recycling box provides ease in separating all the elements, using the flap (21) and the cavity it leaves for extraction of the tap (11) and the bag, which also allows the insertion of hands to tear the box (22) and the reduction of the box volume for sorting and recycling.

The invention claimed is:

1. A bag-in-box container for storing and transporting liquids with a maximum safety tap for direct consumption or consumption through flexible tubes, wherein the container comprises a flexible bag with a high level of impermeability to liquids and gases for containing a liquid product and a stabilizing box in which the bag is housed once it is filled with the liquid product, said bag including a tap comprising:

a hollow main body, with first and second open ends, that can be covered at the end portion thereof, in two height positions;

a connector, at the first end of the main body, for coupling to the bag through another connector of a lower height, welded to the bag;

a third outlet spout, in the main body, to serve the liquid product from the main body;

two windows, at the second end of the main body, which pass through the main body;

an access hole, inside the main body, which is in fluid communication with the third spout, which is automatically emptied after each dispensation and closure;

an elastic flow interrupter, housed in the main body, and comprising a first portion, fixed by pressure internally to the main body, and another elastic portion able to deform to alternately cover and free the access hole;

an actuator element with two flanges, which can be housed at the second end of the main body, and comprising: an axially rotating bushing able to move in the main body; and a shutter fastened with the elastic element;

respective flanges, able to be actuated to move the bushing away from the closing seat, from a normal closed position to another open position in which the liquid has access to the main body;

grooves, in the main body, in prolongation of the windows, for housing the supports for the flanges, in the tap safety closed position, by means of the axial rotation of the bushing; and rotation to another level through the grooves for securing the same supports in a permanent open position for independent control of the content, wherein the tap incorporates a second spout configured as a hollow dip tube, protruding from the coupling towards the bag, moving away from the main body, up to the proximity of the base of the connector, which, in a full container position in which the container is welded to the bag and connected by pressure to the connector after filling the bag, includes a perimeter row of corrugations in its final circle, which prevent the blocking of the exit of the content in the bag through the second spout and the third spout until the complete emptying of the container; there being envisaged that radial fins are internally configured in the third spout, in the second third of said third spout from its beginning attached to the main body, as retention means for retaining residual liquid by internal wetting, having at the end of the third spout a reduction in diameter at its end, which is turned into a circular inner edge determining retentions means for retaining said relatively cumulative wetting.

2. The bag-in-box container according to claim 1, wherein the second spout and the third spout determine flexible tube connection means, in independent dispensing operations, from a height and from the container at a short distance, direct and visible without having to move the bag-in-box container, preventing the connection of a second safety tap without the connector at the second end of the flexible tube, for total comfort.

3. The bag-in-box container according to claim 1, wherein, together with same, flexible tubes are involved for transporting the content from the container, in which the tap gives access to the outside through the third spout prepared for the adjustment and retention of said preferably black, light-insulating, plastic tubes, inserting the standard accessories required for the connection, regulation and transport of contents at a distance, for metered mixtures of various liquid and gas products, being able to have more safety taps without a connector, inserted in the path or at the end, which can be connected to the most suitable one of any of their respective second spout or third spout, for any control and accessory change operation.

4. The bag-in-box container according to claim 1, wherein it includes a space movable between the shutter and the elastic element, as recovery means at the start of the opening movement, upon the release of the seal and the subsequent pressure and retention of the supports of the flanges through the grooves, said elastic element adopting its typical hemispherical polar configuration and once free in said opening movement, offering easy exit of the elastic element through the access hole, transitioning from a closed maximum safety position to the easy-to-open position.

5. The bag-in-box container according to claim 1, wherein it includes a nozzle that can be coupled to the third spout, with an outlet hole having a very small diameter for direct dispensation from the container to the user.

6. The bag-in-box container according to claim 1, wherein it includes on the face of the handle of the box information about the possibilities of recycling its different plastic components, with printed information on the manufacturer's key, graphic identification code on all plastics, and the identification number of each group from 1 to 5 inside the code, printed only on each recyclable unit in yellow color in order to sort and recover the remaining non-recyclable residues for compost and other uses.

7. The bag-in-box container according to claim 1, characterized by positioning the perforation in the upper portion of the box contrary to the historical position, for use in handling and transportation and for the user to insert his/her fingers in order to extract and position the tap, transitioning to the second position, by means of a 180-degree vertical rotation; there being envisaged that in the event of any loss of content, the container is rotated to the first position for recovery of same.

8. The bag-in-box container according to claim 2, wherein it includes a space movable between the shutter and the clastic element, as recovery means at the start of the opening movement, upon the release of the seal and the subsequent pressure and retention of the supports of the flanges through the grooves, said clastic element adopting its typical hemispherical polar configuration and once free in said opening movement, offering easy exit of the clastic element through the access hole, transitioning from a closed maximum safety position to the easy-to-open position.

9. The bag-in-box container according to claim 3, wherein it includes a space movable between the shutter and the clastic element, as recovery means at the start of the opening movement, upon the release of the seal and the subsequent pressure and retention of the supports of the flanges through the grooves, said clastic element adopting its typical hemispherical polar configuration and once free in said opening movement, offering easy exit of the clastic element through the access hole, transitioning from a closed maximum safety position to the easy-to-open position.

10. The bag-in-box container according to claim 2, wherein it includes a nozzle that can be coupled to the third spout, with an outlet hole having a very small diameter for direct dispensation from the container to the user.

11. The bag-in-box container according to claim 3, wherein it includes a nozzle that can be coupled to the third spout, with an outlet hole having a very small diameter for direct dispensation from the container to the user.

12. The bag-in-box container according to claim 4, wherein it includes a nozzle that can be coupled to the third spout, with an outlet hole having a very small diameter for direct dispensation from the container to the user.

13. The bag-in-box container according to claim 2, wherein it includes on the face of the handle of the box information about the possibilities of recycling its different plastic components, with printed information on the manufacturer's key, graphic identification code on all plastics, and the identification number of each group from 1 to 5 inside the code, printed only on each recyclable unit in yellow color in order to sort and recover the remaining non-recyclable residues for compost and other uses.

14. The bag-in-box container according to claim 3, wherein it includes on the face of the handle of the box information about the possibilities of recycling its different plastic components, with printed information on the manufacturer's key, graphic identification code on all plastics, and the identification number of each group from 1 to 5 inside the code, printed only on each recyclable unit in yellow color in order to sort and recover the remaining non-recyclable residues for compost and other uses.

15. The bag-in-box container according to claim 4, wherein it includes on the face of the handle of the box information about the possibilities of recycling its different plastic components, with printed information on the manufacturer's key, graphic identification code on all plastics, and the identification number of each group from 1 to 5 inside the code, printed only on each recyclable unit in yellow color in order to sort and recover the remaining non-recyclable residues for compost and other uses.

16. The bag-in-box container according to claim 5, wherein it includes on the face of the handle of the box information about the possibilities of recycling its different plastic components, with printed information on the manufacturer's key, graphic identification code on all plastics, and the identification number of each group from 1 to 5 inside the code, printed only on each recyclable unit in yellow color in order to sort and recover the remaining non-recyclable residues for compost and other uses.

17. The bag-in-box container according to claim 2, characterized by positioning the perforation in the upper portion of the box contrary to the historical position, for use in handling and transportation and for the user to insert his/her fingers in order to extract and position the tap, transitioning to the second position, by means of a 180-degree vertical rotation; there being envisaged that in the event of any loss of content, the container is rotated to the first position for recovery of same.

18. The bag-in-box container according to claim 3, characterized by positioning the perforation in the upper portion of the box contrary to the historical position, for use in handling and transportation and for the user to insert his/her fingers in order to extract and position the tap, transitioning to the second position, by means of a 180-degree vertical rotation; there being envisaged that in the event of any loss of content, the container is rotated to the first position for recovery of same.

19. The bag-in-box container according to claim 4, characterized by positioning the perforation in the upper portion of the box contrary to the historical position, for use in handling and transportation and for the user to insert his/her fingers in order to extract and position the tap, transitioning to the second position, by means of a 180-degree vertical rotation; there being envisaged that in the event of any loss of content, the container is rotated to the first position for recovery of same.

20. The bag-in-box container according to claim 5, characterized by positioning the perforation in the upper portion of the box contrary to the historical position, for use in handling and transportation and for the user to insert his/her fingers in order to extract and position the tap, transitioning to the second position, by means of a 180-degree vertical rotation; there being envisaged that in the event of any loss of content, the container is rotated to the first position for recovery of same.

* * * * *